US009470993B2

(12) United States Patent
Nishikawa et al.

(10) Patent No.: US 9,470,993 B2
(45) Date of Patent: Oct. 18, 2016

(54) MAGNETIC TONER

(71) Applicant: CANON KABUSHIKI KAISHA, Tokyo (JP)

(72) Inventors: Koji Nishikawa, Susono (JP); Kosuke Fukudome, Tokyo (JP); Shotaro Nomura, Suntou-gun (JP); Hiroki Akiyama, Toride (JP); Shohei Tsuda, Suntou-gun (JP); Daisuke Yoshiba, Suntou-gun (JP); Katsuhisa Yamazaki, Numazu (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 14/807,656

(22) Filed: Jul. 23, 2015

(65) Prior Publication Data

US 2016/0041483 A1 Feb. 11, 2016

(30) Foreign Application Priority Data

Aug. 7, 2014 (JP) ..... 2014-161477

(51) Int. Cl.
*G03G 9/08* (2006.01)
*G03G 9/083* (2006.01)

(52) U.S. Cl.
CPC ..... *G03G 9/0835* (2013.01); *G03G 9/0827* (2013.01); *G03G 9/0834* (2013.01); *G03G 9/0836* (2013.01); *G03G 9/0839* (2013.01)

(58) Field of Classification Search
CPC ..... G03G 9/0835; G03G 9/0836; G03G 9/0834; G03G 9/0839
USPC ..... 430/111.35
See application file for complete search history.

(56) References Cited

U.S. PATENT DOCUMENTS

| | | | |
|---|---|---|---|
| 7,544,455 | B2 | 6/2009 | Yoshiba et al. |
| 8,227,162 | B2 | 7/2012 | Sano et al. |
| 8,426,094 | B2 | 4/2013 | Magome et al. |

(Continued)

FOREIGN PATENT DOCUMENTS

| | | | |
|---|---|---|---|
| JP | 2000-292972 | A | 10/2000 |
| JP | 2006-91935 | A | 4/2006 |

(Continued)

OTHER PUBLICATIONS

U.S. Appl. No. 14/812,793, filed Jul. 29, 2015. Inventors: Shohei Tsuda, et al.

*Primary Examiner* — Mark A Chapman
(74) *Attorney, Agent, or Firm* — Fitzpatrick, Cella, Harper & Scinto

(57) ABSTRACT

The present invention provides a magnetic toner that is excellent in low temperature fixability and that is also excellent in developability, suppression of fogging and transfer efficiency even in a long period of use. The magnetic toner of the present invention is a magnetic toner including a magnetic toner particle containing a binder resin and a magnetic member, and an inorganic fine particle "a" and an organic-inorganic composite fine particle, wherein the magnetic toner has (i) a true specific gravity of 1.40 g/cm$^3$ or more and 1.70 g/cm$^3$ or less, and (ii) a saturation magnetization at a magnetic field of 796 kA/m of 10 Am$^2$/kg or more and 20 Am$^2$/kg or less, and the inorganic fine particle "a" is a metal oxide having a volume resistivity of $1.0\times10^3$ Ω·cm or more and $1.0\times10^8$ Ω·cm or less.

5 Claims, 2 Drawing Sheets

(56) References Cited

U.S. PATENT DOCUMENTS

| | | | |
|---|---|---|---|
| 8,501,377 | B2 | 8/2013 | Takahashi et al. |
| 8,512,925 | B2 | 8/2013 | Moribe et al. |
| 9,097,997 | B2 | 8/2015 | Nomura et al. |
| 2007/0202424 | A1 | 8/2007 | Ogawa et al. |
| 2014/0295341 | A1 | 10/2014 | Fomitchev et al. |
| 2014/0315125 | A1 | 10/2014 | Matsui et al. |
| 2015/0125790 | A1 | 5/2015 | Hotta et al. |

FOREIGN PATENT DOCUMENTS

| | | | |
|---|---|---|---|
| JP | 4321272 | B2 | 8/2009 |
| JP | 2013-92748 | A | 5/2013 |
| WO | 2013/063291 | A1 | 5/2013 |

MAGNETIC TONER

BACKGROUND OF THE INVENTION

1. Field of the Invention

The present invention relates to a magnetic toner for use in an image forming method such as an electrophotographic method.

2. Description of the Related Art

An electrophotographic image forming apparatus is demanded to achieve a higher speed, a longer lifetime and saving of energy, and a toner is also demanded to have still further enhanced various performances in order to respond to such demands. In particular, it is important for a longer lifetime that transfer efficiency and developability of a toner be kept even in a long period of use. In addition, a toner is demanded to have still further enhanced low temperature fixability from the viewpoints of a high speed and saving of energy.

Furthermore, an apparatus such as a copier and a printer is being downsized, and a magnetic one-component development system using a magnetic toner that is advantageous in terms of such viewpoints can be used.

Various toners have been proposed in order that a magnetic toner satisfies stable transfer efficiency and developability, and still more enhanced low temperature fixability over a long period of time. Japanese Patent Application Laid-Open No. 2006-91935 has proposed addition of an external additive having an adjusted specific resistance to a magnetic toner to result in enhancements in durability and chargeability. Japanese Patent No. 4321272 has proposed external addition of a composite resin particle of a silica particle and a melamine resin particle to a magnetic toner to result in an enhancement in developability and suppression of image deletion. Japanese Patent Application Laid-Open No. 2000-292972 has proposed external addition of silica having a large particle diameter to a magnetic toner to result in an enhancement in developability and suppression of fogging. Japanese Patent Application Laid-Open No. 2013-92748 and International Publication No. WO2013/063291 have proposed external addition of a composite particle including an inorganic fine particle embedded in the surface of a resin fine particle to result in an enhancement in durability.

SUMMARY OF THE INVENTION

The present inventors have made studies about the toners described in Literatures above, and as a result, have found that the toner according to Japanese Patent Application Laid-Open No. 2006-91935 still has room for improvements in low temperature fixability, and developability and transfer efficiency in a long period of use, the toner according to Japanese Patent No. 4321272 still has room for an improvement in low temperature fixability and for suppression of fogging in a long period of use, the toner according to Japanese Patent Application Laid-Open No. 2000-292972 still has room for improvements in low temperature fixability, and developability and transfer efficiency in a long period of use, and the toners according to Japanese Patent Application Laid-Open No. 2013-92748 and International Publication No. WO2013/063291 still have room for an improvement in developability, for suppression of fogging and for an improvement in transfer efficiency in a long period of use.

The present invention is directed to providing a magnetic toner that is excellent in low temperature fixability, and that is also excellent in developability, suppression of fogging and transfer efficiency even in a long period of use.

According to one aspect of the present invention, there is provided a magnetic toner comprising a magnetic toner particle containing a binder resin and a magnetic member, and an inorganic fine particle "a" and an organic-inorganic composite fine particle, wherein the magnetic toner has (i) a true specific gravity of 1.40 g/cm$^3$ or more and 1.70 g/cm$^3$ or less, and (ii) a saturation magnetization at a magnetic field of 796 kA/m of 10 Am$^2$/kg or more and 20 Am$^2$/kg or less, the inorganic fine particle "a" is a metal oxide having a volume resistivity of $1.0\times10^3$ Ω·cm or more and $1.0\times10^8$ Ω·cm or less, and the organic-inorganic composite fine particle comprises a resin particle, and an inorganic fine particle "b" embedded in the resin particle, and the organic-inorganic composite fine particle has a true specific gravity of 1.50 g/cm$^3$ or more and 1.75 g/cm$^3$ or less.

The present invention can provide a magnetic toner that is excellent in low temperature fixability and that is also excellent in developability, suppression of fogging and transfer efficiency even in a long period of use.

Further features of the present invention will become apparent from the following description of exemplary embodiments with reference to the attached drawings.

DESCRIPTION OF THE EMBODIMENTS

Figure 1:
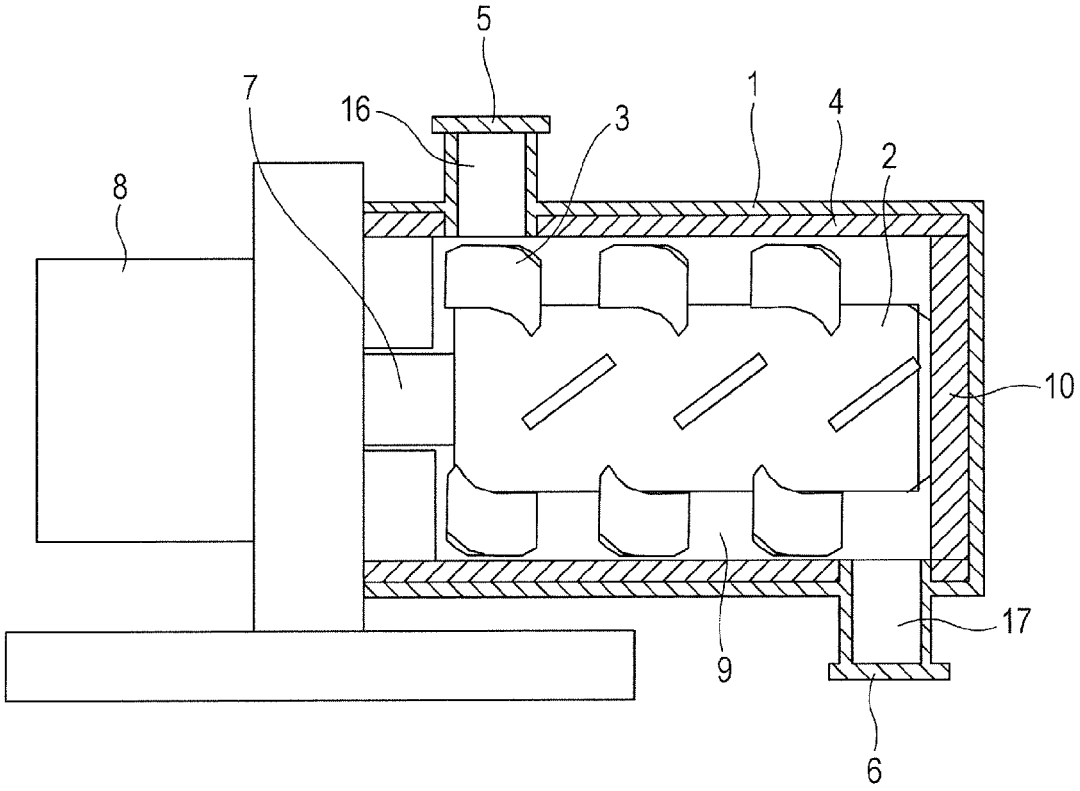
FIG. 1 is a schematic view illustrating one example of a mixing treatment apparatus for use in mixing of an external additive.

Preferred embodiments of the present invention will now be described in detail in accordance with the accompanying drawings.

The present invention relates to a magnetic toner including a magnetic toner particle containing a binder resin and a magnetic member, and an inorganic fine particle "a" and an organic-inorganic composite fine particle, wherein the magnetic toner has (i) a true specific gravity of 1.40 g/cm$^3$ or more and 1.70 g/cm$^3$ or less, and (ii) a saturation magnetization at a magnetic field of 796 kA/m of 10 Am$^2$/kg or more and 20 Am$^2$/kg or less, the inorganic fine particle "a" is a metal oxide having a volume resistivity of $1.0\times10^3$ Ω·cm or more and $1.0\times10^8$ Ω·cm or less, and the organic-inorganic composite fine particle comprises a resin particle and an inorganic fine particle "b" embedded in the resin particle, and the organic-inorganic composite fine particle has a true specific gravity of 1.50 g/cm$^3$ or more and 1.75 g/cm$^3$ or less.

According to studies by the present inventors, the above magnetic toner can be used to result in an improvement in low temperature fixability, and also an improvement in developability, suppression of fogging and an improvement in transfer efficiency even in a long period of use.

The magnetic toner according to the present invention can be applied to a magnetic one-component development system in which a toner bearing member (hereinafter, referred to as "developing sleeve") including a magnetic field-generating unit such as a magnet roll provided therein is used to convey the magnetic toner to a developing region for performing development. Imparting of charge to the magnetic toner is mainly performed in a region, where the magnetic toner is regulated by a toner regulating member, by triboelectric charging due to sliding friction between the magnetic toner and a triboelectric charging member of the developing sleeve.

In the magnetic toner according to the present invention, the content of the magnetic member in the magnetic toner can be decreased to result in an enhancement in low temperature fixability.

On the other hand, when the content of the magnetic member in the magnetic toner is decreased, low temperature fixability is enhanced, but the content of a magnetic member having a low volume resistivity is decreased to thereby cause charging of the magnetic toner to be less likely to leak. As a result, the magnetic toner is excessively charged on the developing sleeve (referred to as charge up). In particular, when printing under a low-temperature and low-humidity environment or printing at a low printing rate where the magnetic toner is less consumed is continued, the magnetic toner on the developing sleeve is easily charged up. When the magnetic toner is charged up, the magnetic toner strongly adheres to the developing sleeve and the magnetic toner is less likely to be developed, and it is therefore difficult to keep stable developability.

Then, an inorganic fine particle "a" having a low volume resistivity can be externally added to a magnetic toner particle in which the content of the magnetic member in the magnetic toner is decreased, to thereby decrease the volume resistivity of the magnetic toner and suppress charge up on the developing sleeve.

Even when a design, however, is adopted in which the inorganic fine particle "a" having a low volume resistivity is externally added to the magnetic toner particle in which the content of the magnetic member is decreased, to thereby suppress charge up of the magnetic toner, it is difficult to achieve stable performances in a long period of use. The magnetic toner is repeatedly subjected to sliding friction in a long period of use to thereby cause the inorganic fine particle "a" on the surface of the magnetic toner to be embedded, to be less likely to leak charging of the magnetic toner. In addition, sliding friction causes the inorganic fine particle "a" to move on the surface of the magnetic toner, to thereby generate deviation of the existence distribution of the inorganic fine particle "a" on the magnetic toner, easily resulting in a broad charging distribution of the magnetic toner and the occurrence of fogging and deterioration in developability.

The present inventors have made various studies in order to obtain a toner that can be stably charged over a long period by suppression of movement of the inorganic fine particle "a". As a result, the present inventors have found that an organic-inorganic composite fine particle having a true specific gravity close to the true specific gravity of the magnetic toner particle can be externally added to thereby control chargeability, improve developability, suppress fogging and also improve transfer efficiency, of the magnetic toner even in a long period of use.

The reason for being capable of improving developability, suppressing fogging and also improving transfer efficiency, of the magnetic toner even in a long period of use, is considered as follows.

It is considered that the organic-inorganic composite fine particle and the magnetic toner have a true specific gravity close to each other to thereby allow powders of the magnetic toner particle and the organic-inorganic composite fine particle to uniformly flow in an external addition apparatus, allowing the organic-inorganic composite fine particle to be uniformly dispersed in and externally added to the magnetic toner easily.

Furthermore, the organic-inorganic composite fine particle comprises a resin particle and an inorganic fine particle "b" embedded in the resin particle, and is therefore less likely to roll on the surface of the magnetic toner even in repeating of sliding friction of the magnetic toner and is easily kept in the state of being uniformly dispersed.

The organic-inorganic composite fine particle is uniformly dispersed in and externally added to the magnetic toner easily, and therefore the existence distribution of the inorganic fine particle "a" is also easily uniform. In addition, the organic-inorganic composite fine particle and the magnetic toner have a true specific gravity close to each other to thereby allow the organic-inorganic composite fine particle to be less likely to be embedded in the surface of the magnetic toner even in a long period of use, and as a result, the existence distribution of the inorganic fine particle "a" can also be uniformly kept. As a result, it is considered that the magnetic toner of the present invention can be kept in the state of having a sharp charging distribution, to thereby allow developability and fogging to be improved and suppressed, respectively, in a long period of use.

The reason for an improvement in transfer efficiency is presumed as follows.

A transfer bias is applied to paper (medium) to thereby transfer on the paper a toner on a drum.

A design is adopted in which a toner particle and the organic-inorganic composite fine particle have a true specific gravity close to each other, to thereby allow the organic-inorganic composite fine particle to be less likely to be embedded in the surface of the magnetic toner. Furthermore, the organic-inorganic composite fine particle is almost uniformly dispersed on the surface of the magnetic toner. As a result, it is considered that the adhesion force between the magnetic toner and a drum surface is decreased and therefore the organic-inorganic composite fine particle acts as a kind of spacer for easy separation from the drum surface.

Moreover, when the organic-inorganic composite fine particle is almost uniformly dispersed on the surface of the magnetic toner, a sharp charging distribution is easily achieved and most of the magnetic toner on the drum is easily transferred on the paper in application of the transfer bias on the paper. Thus, it is considered that the adhesion force between the magnetic toner and the drum can be decreased and transferring is advantageously made in terms of charging to thereby impart good transfer efficiency.

The magnetic toner according to the present invention is required to have a true specific gravity of 1.40 g/cm$^3$ or more and 1.70 g/cm$^3$ or less from the viewpoint of an enhancement in low temperature fixability. In addition, in order to also allow the organic-inorganic composite fine particle to be less likely to move on and be embedded in the magnetic toner, it is important that the true specific gravity of the magnetic toner be in the above range.

If the true specific gravity is less than 1.40 g/cm$^3$, not only conveyance on the developing sleeve is difficult and developability easily deteriorates, but also the magnetic binding force of the magnetic toner to the developing sleeve is decreased, and therefore fogging is easily caused. In addition, the organic-inorganic composite fine particle is easily embedded in the surface of the magnetic toner. If the true specific gravity is more than 1.70 g/cm$^3$, low temperature fixability decreases.

When the true specific gravity of the magnetic toner is set to be 1.40 g/cm$^3$ or more and 1.70 g/cm$^3$ or less, it is important that the saturation magnetization at a magnetic field of 796 kA/m of the magnetic toner be 10 Am$^2$/kg or more and 20 Am$^2$/kg or less. If the saturation magnetization is less than 10 Am$^2$/kg, not only conveyance on the developing sleeve is difficult and developability easily decreases, but also the magnetic binding force of the magnetic toner to the developing sleeve is decreased, and therefore fogging is easily caused. If the saturation magnetization is more than 20 Am$^2$/kg, the true specific gravity of the magnetic toner is large to easily reduce low temperature fixability. It is important that the inorganic fine particle "a" for suppression of charge up of the magnetic toner be a metal oxide having a volume resistivity of $1.0\times10^3$ Ω·cm or more and $1.0\times10^8$ Ω·cm or less. If the volume resistivity is more than $1.0\times10^8$ Ω·cm, the effect of alleviating charge up of the magnetic toner is less likely to be exerted to easily reduce developability. If the volume resistivity is less than $1.0\times10^3$ Ω·cm, charging of the magnetic toner is easily leaked to easily reduce developability.

It is important that the organic-inorganic composite fine particle for use in the magnetic toner according to the present invention comprises a resin particle and the inorganic fine particle "b" embedded in the resin particle. The inorganic fine particle "b" is embedded in the resin particle to thereby allow the organic-inorganic composite fine particle to be less likely to move on the surface of the magnetic toner even in repeating of sliding friction of the magnetic toner to be easily kept in the state of being uniformly dispersed. Furthermore, when the inorganic fine particle "b" is embedded in the resin particle, the inorganic fine particle "b" is less likely to be separated from the resin particle. Therefore, the organic-inorganic composite fine particle is not changed in terms of the true specific gravity even in a long period of use and therefore is easily kept in the state of being uniformly dispersed on the magnetic toner. Therefore, developability, suppression of fogging and transfer efficiency are kept even in a long period of use.

Herein, for example, when the resin particle and the inorganic fine particle "b" are externally added at the same time, or when the resin fine particle and the inorganic fine particle are externally added sequentially, the resin particle and the inorganic fine particle "b" may, for example, aggregate on the magnetic toner particle and appear to be an integrated organic-inorganic composite fine particle. Such a method, however, may often cause insufficient embedding of the inorganic fine particle "b" in the resin fine particle, and is therefore unlikely to impart the effect of the present invention.

It is important that the organic-inorganic composite fine particle have (ii) a true specific gravity of 1.50 g/cm$^3$ or more and 1.75 g/cm$^3$ or less. If the true specific gravity is less than 1.50 g/cm$^3$, the organic-inorganic composite fine particle is difficult to disperse on the surface of the magnetic toner, or the organic-inorganic composite fine particle easily moves on the surface of the magnetic toner due to sliding friction. Therefore, fogging is easily caused and deteriorations in developability and transfer efficiency are easily caused in a long period of use. If the true specific gravity is more than 1.75 g/cm$^3$, the organic-inorganic composite fine particle is easily embedded in the surface of the magnetic toner in a long period of use, and developability, suppression of fogging and transfer efficiency are easily poor.

The organic-inorganic composite fine particle in the present invention can (iii) have a plurality of convex portions derived from the inorganic fine particle "b" on the surface from the viewpoint of control of the adhesion force to the toner surface, and (iv) have a number average primary particle diameter (D1) of 50 nm or more and 200 nm or less from the viewpoint of being externally added to the surface of the magnetic toner uniformly.

The content of the organic-inorganic composite fine particle in the present invention can be 0.50% by mass or more and 3.00% by mass or less based on the mass of the magnetic toner particle from the viewpoint of being allowing durability to be kept.

The organic-inorganic composite fine particle in the present invention can have, as an index of the shape, a shape factor SF-2 of 103 or more and 120 or less measured using a magnification image of the organic-inorganic composite fine particle taken using a scanning electron microscope at 200000-fold magnification. The shape factor SF-2 is an index of the degree of concavity and convexity of a particle, and the shape is a true circle when the shape factor is 100, and the degree of concavity and convexity is increased as the numerical value of the shape factor is larger.

When the SF-2 is in the above range, the organic-inorganic composite fine particle is less likely to move on the surface of the magnetic toner even in a long period of use, and therefore a uniform existence distribution is easily kept and developability is less likely to decrease.

The organic-inorganic composite fine particle in the present invention can be produced according to, for example, the description of Examples in International Publication No. WO2013/063291. The inorganic fine particle "b" for use in the organic-inorganic composite fine particle is not particularly limited, and can be a silica fine particle, an alumina fine particle, a titania fine particle, a zinc oxide fine particle, a strontium titanate fine particle, a cerium oxide fine particle and a calcium carbonate fine particle in the present invention from the viewpoint of imparting fluidity. Two or more selected from the group consisting of such fine particles can also be used as an arbitrary combination.

The number average primary particle diameter (D1) of the inorganic fine particle "b" can be 10 nm or more and 70 nm or less from the viewpoint that the number average primary particle diameter (D1) and the true specific gravity of the organic-inorganic composite fine particle are controlled.

The inorganic fine particle "a" in the present invention is a metal oxide, and examples include iron oxide, titanium oxide, tin oxide, zinc oxide, silicon oxide (silica) and aluminum oxide. Such fine particles in the group may be adopted to have an adjusted volume resistivity as a composite oxide of two or more selected as an arbitrary combination, even if being singly a material whose volume resistivity does not fall within the range of the volume resistivity in the present invention.

The inorganic fine particle "a" in the present invention can have a number average primary particle diameter (D1) of 10 nm or more and 500 nm or less from the viewpoint that the volume resistivity of the magnetic toner is reduced to suppress charge up.

The content of the inorganic fine particle "a" in the present invention can be 0.05% by mass or more and 5.0% by mass or less based on the mass of the magnetic toner particle from the viewpoint that the volume resistivity of the magnetic toner is reduced to suppress charge up.

The magnetic toner according to the present invention can be a magnetic toner having an amount of triboelectric charging of −65 mC/kg or more and −45 mC/kg or less measured using a standard carrier in the Imaging Society of Japan (N-01) by a two-component method. When the amount of triboelectric charging is in the above range, developability is further improved.

The toner according to the present invention may include an external additive other than the organic-inorganic composite fine particle and the inorganic fine particle "a". In particular, in order to enhance fluidity and chargeability of the toner, a flow improver can be added as other external additive.

The following can be used for the flow improver.

Examples include fluororesin powders such as a vinylidene fluoride fine powder and a polytetrafluoroethylene fine powder; fine powder silicas such as wet process silica and dry process silica, fine powder titanium oxide, fine powder alumina, and silica obtained by subjecting each of such fine powders to a surface treatment with a silane compound, a titanium coupling agent or a silicone oil; oxides such as zinc oxide and tin oxide; composite oxides such as strontium titanate, barium titanate, calcium titanate, strontium zirconate and calcium zirconate; and carbonate compounds such as calcium carbonate and magnesium carbonate.

The flow improver can be a fine powder produced by vapor phase oxidation of a silicon halogen compound, which is referred to as so-called dry process silica or fumed silica. The flow improver can be, for example, one obtained by utilizing a pyrolysis oxidation reaction of a silicon tetrachloride gas in an oxy-hydrogen flame, and the basic reaction formula is as follows.

$$SiCl_4+2H_2+O_2 \rightarrow SiO_2+4HCl$$

In the above production process, other metal halogen compound such as aluminum chloride or titanium chloride can also be used together with the silicon halogen compound to provide a composite fine powder of silica and other metal oxide, and the composite fine powder is also encompassed in silica.

The number average primary particle diameter in the particle diameter distribution on a number basis can be 5 nm or more and 30 nm or less because high chargeability and fluidity can be imparted.

Furthermore, the flow improver for use in the present invention is more preferably a silica fine powder treated, which is obtained by subjecting the silica fine powder produced by gas phase oxidation of the silicon halogen compound, to a hydrophobizing treatment. For the hydrophobizing treatment, the same method as in the surface treatment of the organic-inorganic composite fine particle or the inorganic fine particle for use in the organic-inorganic composite fine particle can be used.

The flow improver can have a specific surface area by nitrogen adsorption measured by the BET method of 30 $m^2/g$ or more and 300 $m^2/g$ or less. The flow improver may be used in a total amount of 0.01 parts by mass or more and 3 parts by mass or less based on 100 parts by mass of the toner.

The toner according to the present invention, which is mixed with the flow improver or is if necessary mixed with still other external additive (for example, charge controlling agent), can be used as a one-component developer.

Next, the toner particle in the present invention is described.

First, the binder resin for use in the toner particle in the present invention includes a polyester type resin, a vinyl resin, an epoxy resin and a polyurethane resin. In particular, a polyester resin can be contained in terms of low temperature fixability. The binder resin can have a glass transition point (Tg) of 45° C. or more and 70° C. or less in terms of storage stability.

The magnetic member for use in the magnetic toner according to the present invention includes iron oxides such as magnetite, hematite and ferrite, metals such as iron, cobalt and nickel, and alloys and mixtures of such metal(s) and metal(s) such as aluminum, cobalt, copper, lead, magnesium, tin, zinc, antimony, bismuth, calcium, manganese, titanium, tungsten and vanadium. Such a magnetic member can have an average particle diameter of 0.05 μm or more and 2 μm or less.

While the magnetic member can also play a role as a black colorant concurrently, carbon black or grafted carbon as a black colorant may also be further used in combination.

The toner according to the present invention may further contain a wax. Specific examples of the wax include the following.

- aliphatic hydrocarbon type waxes such as low molecular weight polyethylene, low molecular weight polypropylene, a polyolefin copolymer, a polyolefin wax, a microcrystalline wax, a paraffin wax and a Fischer-Tropsch wax;
- oxides of aliphatic hydrocarbon type waxes, such as a polyethylene oxide wax; or block copolymers thereof;
- vegetable waxes such as a candelilla wax, a carnauba wax, a haze wax and a jojoba wax;
- animal waxes such as a beeswax, lanolin and spermaceti;
- mineral waxes such as ozokerite, ceresin and petrolatum;
- waxes mainly including an aliphatic ester, such as a montanic acid ester wax and a castor wax; and
- waxes, in which a part or all of an aliphatic ester is deoxidized, such as a deoxidized carnauba wax.

Furthermore, examples include saturated straight fatty acids such as palmitic acid, stearic acid, montanic acid or long chain alkyl carboxylic acids having a further long alkyl group; unsaturated fatty acids such as brassidic acid, eleostearic acid and parinaric acid; saturated alcohols such as stearyl alcohol, eicosyl alcohol, behenyl alcohol, carnaubyl alcohol, ceryl alcohol, melissyl alcohol or an alkyl alcohol having a further long chain alkyl group; polyhydric alcohols such as sorbitol; fatty acid amides such as linoleic acid amide, oleic acid amide and lauric acid amide; saturated aliphatic bisamides such as methylenebis(stearic acid amide), ethylenebis(capric acid amide), ethylenebis(lauric acid amide) and hexamethylenebis(stearic acid amide); unsaturated fatty acid amides such as ethylenebis(oleic acid amide), hexamethylenebis(oleic acid amide), N,N'-dioleyladipic acid amide and N,N'-dioleylsebacic acid amide; aromatic bisamides such as m-xylenebis(stearic acid amide) and N,N'-distearylisophthalic acid amide; aliphatic metal salts (generally referred to as metal soaps) such as calcium stearate, calcium laurate, zinc stearate and magnesium stearate; waxes obtained by grafting a vinyl monomer such as styrene or acrylic acid to an aliphatic hydrocarbon type wax; partially esterified products of a fatty acid such as monoglyceride behenate and a polyhydric alcohol; and methyl ester compounds having a hydroxyl group, obtained by hydrogenation of a vegetable fat.

In addition, such a wax having a sharp molecular weight distribution by using a press sweating method, a solvent method, a recrystallization method, a vacuum distillation method, a supercritical gas extraction method or a melt crystallization method can also be suitably used. Furthermore, a wax from which impurities such as a low molecular weight solid fatty acid, a low molecular weight solid alcohol and a low molecular weight solid compound are removed can also be suitably used.

Specific examples of a wax for use as a release agent include Biscol (registered trademark) 330-P, 550-P, 660-P and TS-200 (produced by Sanyo Chemical Industries, Ltd.), Hi-Wax 400P, 200P, 100P, 410P, 420P, 320P, 220P, 210P and 110P (produced by Mitsui Chemicals, Inc.), Sasol H1, H2, C80, C105 and C77 (produced by Schumann Sasol), HNP-1, HNP-3, HNP-9, HNP-10, HNP-11 and HNP-12 (produced by Nippon Seiro Co., Ltd.), Unilin (registered trademark) 350, 425, 550 and 700, Unisid (registered trademark), and Unisid (registered trademark) 350, 425, 550 and 700 (produced by Toyo-Petrolite Co., Ltd.), and a haze wax, a beeswax, a rice wax, a candelilla wax and a carnauba wax (available from CERARICA NODA Co., Ltd.).

A charge-controlling agent can be used in the toner according to the present invention in order to stabilize chargeability of the toner. For such a charge-controlling agent, an organometallic complex or a chelate compound whose central metal easily interacts with an acid group or a hydroxyl group present at the end of the binder resin for use in the present invention is effective. Examples include a monoazo metal complex; an acetylacetone metal complex; and a metal complex or a metal salt of an aromatic hydroxycarboxylic acid or an aromatic dicarboxylic acid.

Specific examples usable include Spilon Black TRH, T-77 and T-95 (Hodogaya Chemical Co., Ltd.), and BONTRON (registered trademark) S-34, S-44, S-54, E-84, E-88 and E-89 (Orient Chemical Industries Co., Ltd.). A charge-controlling resin can also be used in combination with the above charge-controlling agent.

The method for producing the toner particle in the present invention is not particularly limited, and for example, a pulverizing method, or a so-called polymerization method such as an emulsion polymerization method, a suspension polymerization method and a solution suspension method can be used.

In the pulverizing method, first, the binder resin, the magnetic member, the wax, the charge-controlling agent and the like forming the toner particle are sufficiently mixed by a mixer such as a Henschel mixer or a ball mill. Next, the resulting mixture is molten and kneaded using a thermal kneader such as a twin screw kneading extruder, a heating roll, a kneader or an extruder, cooled and solidified, and thereafter pulverized and classified. Thus, the toner particle in the present invention is obtained. An external additive can be externally added to and mixed with the resulting magnetic toner particle to thereby provide a magnetic toner.

The mixer includes the following: a Henschel mixer (manufactured by Mitsui Mining Co., Ltd.); Super Mixer (manufactured by Kawatamfg Co., Ltd.); Ribocorn (manufactured by Okawara Mfg. Co., Ltd.); Nautor Mixer, Turbulizer and Cycromix (manufactured by Hosokawa Micron Group); Spiral pin mixer (manufactured by Pacific Machinery & Engineering Co., Ltd.); and Loedige Mixer (manufactured by Matsubo Corporation).

The kneader includes the following: a KRC kneader (manufactured by Kurimoto, Ltd.); a Buss co-kneader (manufactured by Buss); a TEM type extruder (manufactured by Toshiba Machine Co., Ltd.); a TEX twin-screw kneader (manufactured by Japan Steel Works, Ltd.); a PCM kneader (manufactured by Ikegai); a three-roll mill, a mixing roll mill and a kneader (manufactured by Inoue Mfg., Inc.); Kneadex (manufactured by NIPPON COKE & ENGINEERING Co., Ltd.); an MS type pressure kneader and a kneader-ruder (manufactured by Moriyama); and a Banbury mixer (manufactured by Kobe Steel, Ltd.).

The pulverizer includes the following: a Counter jet mill, Micron jet and Inomizer (manufactured by Hosokawa Micron Group); an IDS type mill and a PJM jet pulverizer (manufactured by Nippon Pneumatic Mfg. Co., Ltd.); Cross-jet Mill (manufactured by Kurimoto, Ltd.); Ulmax (manufactured by Nisso Engineering Co., Ltd.); SK Jet-O-Mill (manufactured by Seisin Enterprise Co., Ltd.); Cliptron (manufactured by Kawasaki Heavy Industries, Ltd.); Turbo Mill (manufactured by Turbo Kogyo Co., Ltd.); and Super Rotor (manufactured by Nisshin Engineering Co., Ltd.).

The classifier includes the following: Classiel, Micron Classifier and Spedic Classifier (manufactured by Seisin Enterprise Co., Ltd.); Turbo Classifier (manufactured by Nisshin Engineering Co., Ltd.); Micron Separator, Turboplex (ATP), TSP Separator (manufactured by Hosokawa Micron Group); Elbow-Jet (manufactured by Nittetsu Mining Co., Ltd.), Dispersion Separator (manufactured by Nippon Pneumatic Mfg. Co., Ltd.); and YM Microcut (manufactured by Yasukawa Shoji K.K.).

A known mixing treatment apparatus such as the above mixers can be used as the mixing treatment apparatus that mixes the external additive, and an apparatus illustrated in FIG. 1 can be adopted from the viewpoint of attaching the external additive to the magnetic toner particle.

FIG. 1 is a schematic view illustrating one example of the mixing treatment apparatus that can be used in mixing of the external additive for use in the present invention.

The mixing treatment apparatus allows the external additive to be easily attached to the surface of the magnetic toner particle because of having a configuration in which a share is applied to the magnetic toner particle and the external additive in a narrow clearance portion.

Measurements of various physical properties of the toner according to the present invention are described below.

<Measurement Method of True Specific Gravity of Each of Magnetic Toner, Organic-Inorganic Composite Fine Particle and Inorganic Fine Particle "a">

The true density of each of the magnetic toner, the organic-inorganic composite fine particle and the inorganic fine particle "a" is measured by a dry automatic densitometer, Auto Pycnometer (manufactured by Yuasa Ionics Co., Ltd.).

When physical properties of the organic-inorganic composite fine particle and the inorganic fine particle "a" in the magnetic toner to which the organic-inorganic composite fine particle and the inorganic fine particle "a" are externally added are measured, the organic-inorganic composite fine particle and the inorganic fine particle "a" can be separated from the magnetic toner and subjected to respective measurements. The magnetic toner is ultrasonic dispersed in methanol, and the organic-inorganic composite fine particle and the inorganic fine particle "a" are separated therefrom and left to still stand for 24 hours. The magnetic toner particle settled, and the organic-inorganic composite fine particle and the inorganic fine particle "a" dispersed in a supernatant liquid can be separated from each other, and recovered and sufficiently dried to be isolated from each other. When other external additive is externally added to the magnetic toner, the supernatant liquid can also be separated by the centrifugation method and isolated to thereby be subjected to measurement.

The conditions are as follows.

Cell: SM cell (10 ml)

Amount of sample: the amount of a sample to be loaded is an amount that fills up about eight out of ten of the cell, but depends on the specific gravity of the sample.

The measuring apparatus is for measuring the true densities of a solid and a liquid according to the gas phase substitution method. While the gas phase substitution method is based on the principle of Archimedes as in the liquid phase substitution method, the accuracy thereof is higher because gas (argon gas) is used as a substitution medium.

<Measurement Method of Magnetic Properties of Magnetic Toner and Magnetic Member>

The magnetic properties of the magnetic toner and the magnetic member are measured using a vibrating magnetometer VSM P-1-10 (manufactured by Toei Industry Co., Ltd.) at an external magnetic field of 796 kA/m.

<Measurement Method of Volume Resistivity of Inorganic Fine Particle "a">

The volume resistivity of the inorganic fine particle "a" is measured as follows. For the apparatus, 6517 Electrometer/High resistance system manufactured by Keithley Instruments is used. The distance between electrodes is measured in the state where the electrodes having a diameter of 25 mm are connected, the inorganic fine particle "a" is placed between the electrodes so as to have a thickness of about 0.5 mm, and a load of about 2.0 N (about 204 g) is applied.

The resistivity in application of a voltage of 1,000 V to the inorganic fine particle "a" for 1 minute is measured and the volume resistivity is calculated using the following expression.

$$\text{Volume resistivity } (\Omega\cdot\text{cm}) = R \times L$$

R: resistivity (Ω)

L: distance between electrodes (cm)

When physical properties of the inorganic fine particle "a" in the magnetic toner to which the inorganic fine particle "a" is externally added are measured, the inorganic fine particle "a" can be separated from the magnetic toner and subjected to measurement. The magnetic toner is ultrasonic dispersed in methanol, and the inorganic fine particle "a" is separated therefrom and left to still stand for 24 hours. The magnetic toner particle settled and the inorganic fine particle "a" dispersed in a supernatant liquid can be separated, and recovered and sufficiently dried to thereby be isolated from each other. When other external additive is externally added to the magnetic toner, the supernatant liquid can be separated by the centrifugation method and isolated to thereby be subjected to measurement.

<Method of Quantitatively Determining Content of Each of Organic-Inorganic Composite Fine Particle and Inorganic Fine Particle "a" in Magnetic Toner>

When the content of each of the organic-inorganic composite fine particle and the inorganic fine particle "a" in the magnetic toner to which the organic-inorganic composite fine particle and the inorganic fine particle "a" are externally added is measured, the organic-inorganic composite fine particle and the inorganic fine particle "a" can be separated from the magnetic toner and subjected to measurement. The magnetic toner is ultrasonic dispersed in methanol, and the organic-inorganic composite fine particle and the inorganic fine particle "a" are separated therefrom and left to still stand for 24 hours. The magnetic toner particle settled, and the organic-inorganic composite fine particle and inorganic fine particle "a" dispersed in a supernatant liquid can be separated, recovered and sufficiently dried to thereby be isolated from each other. When other external additive is externally added to the magnetic toner, the supernatant liquid can also be separated by the centrifugation method and isolated to thereby be subjected to measurement. The amounts of the organic-inorganic composite fine particle, inorganic fine particle "a" isolated are measured to thereby calculate the contents of the organic-inorganic composite fine particle, inorganic fine particle "a" in the magnetic toner, respectively.

<Measurement Method of Amount of Triboelectric Charging of Magnetic Toner by Two-Component Method>

A standard carrier in the Imaging Society of Japan (N-01) (9.5 g) is weighed in a 50-ml poly bottle. The magnetic toner (0.5 g) is weighed thereon, and the humidity is adjusted under an ordinary-temperature and ordinary-humidity environment (23° C., 60%) for 24 hours in the state where the carrier and the magnetic toner are stacked. After the humidity is adjusted, the lid of the poly bottle is closed and the content of the poly bottle is rotated by a roll mill at a rate of one rotation per second for 15 rotations. Subsequently, the specimen is mounted together with the poly bottle to a shaker and shaken at a stroke of 150 times per minute to mix the magnetic toner and the carrier for 5 minutes. The developer here is used as a developer for measurement.

A suction type tribo-charge measuring system SepaSoft STC-1-C1 Model (manufactured by Sankyo Pio-Tech. Co., Ltd.) is used for an apparatus for measuring the amount of triboelectric charging. A mesh (metallic mesh) having an aperture of 20 μm is disposed on the bottom of a sample holder (Faraday gauge), 0.10 g of the developer prepared as described above is loaded thereon, and the lid is closed. The mass of the entire sample holder here is weighed and defined as W1 (g). Next, the sample holder is disposed on the main body and the suction pressure is adjusted to 2 kPa by adjustment of an airflow regulating valve. Suction is performed in the state for 2 minutes to suction and remove the magnetic toner. The charge Q (μC) here is defined as the amount of triboelectric charging. In addition, the mass of the entire sample holder after suction is weighed and defined as W2 (g). The charge Q determined here corresponds to the charge of the carrier measured, and therefore the amount of triboelectric charging of the magnetic toner has a polarity opposite to the polarity of the charge of the carrier. The absolute value of the amount of triboelectric charging (mC/kg) of the developer is calculated according to the following expression. Herein, the measurement is also performed under an ordinary-temperature and ordinary-humidity environment (23° C., 60%).

$$\text{Amount of triboelectric charging (mC/kg)} = Q/(W1 - W2)$$

<Measurement Method of Number Average Primary Particle Diameter (D1) of Each of Organic-Inorganic Composite Fine Particle and Inorganic Fine Particle "a">

Measurement of the number average primary particle diameter (D1) of each of organic-inorganic composite fine particle and the inorganic fine particle "a" is performed using a scanning electron microscope "S-4800" (trade name; manufactured by Hitachi Ltd.). A toner, to which the organic-inorganic composite fine particle and the inorganic fine particle "a" are externally added, is observed, and the longer diameters of primary particles of 100 of the organic-inorganic composite fine particles and the inorganic fine particles a randomly selected in a field of view magnified at up to 200000× are measured to determine the number average particle diameter (D1). The observation magnification is appropriately adjusted depending on the sizes of the organic-inorganic composite fine particle and the inorganic fine particle "a".

<Measurement Method of Shape Factor SF-2 of Organic-Inorganic Composite Fine Particle>

Measurement of the shape factor SF-2 of the organic-inorganic composite fine particle is performed using a scanning electron microscope "S-4800" (trade name; manufactured by Hitachi Ltd.). A magnetic toner, to which the organic-inorganic composite fine particle is externally added, is observed and the shape factor SF-2 is calculated as follows.

The observation magnification is appropriately adjusted depending on the size of the organic-inorganic composite fine particle. The perimeters and the areas of primary particles of 100 of the organic-inorganic composite fine particles randomly selected in a field of view magnified at up to 200000× are calculated using an image processing software "Image-Pro Plus 5.1J" (manufactured by MediaCybernetics Inc.).

The respective SF-2(s) are calculated according to the following expression, and the average thereof is defined as SF-2.

$$SF\text{-}2=(\text{Perimeter of particle})^2/\text{Area of particle}\times 100/4\pi$$

<Measurement Method of Weight Average Particle Diameter (D4) of Toner Particle>

The weight average particle diameter (D4) of the toner is calculated as follows. For the measuring apparatus, a precision particle diameter distribution measuring apparatus "Coulter Counter Multisizer 3" (registered trademark, manufactured by Beckman Coulter Inc.) provided with an aperture tube of 100 μm, by the pore electrical resistance method, is used. Setting of the measurement conditions and analysis of the measurement data are performed using the attached dedicated software "Beckman Coulter Multisizer 3 Version 3.51" (manufactured by Beckman Coulter Inc.). Herein, the measurement is performed in a number of effective measurement channels of 25000.

For the aqueous electrolyte solution for use in the measurement, an aqueous solution obtained by dissolving special grade sodium chloride in ion-exchange water so that the concentration is about 1% by mass, for example, "ISOTON II" (manufactured by Beckman Coulter Inc.) can be used.

Herein, before the measurement and analysis are performed, the dedicated software is set as follows.

In the "Changing Standard Operating Method (SOM)" window of the dedicated software, the total count in the control mode is set to 50000 particles, the number of runs is set to 1, and the Kd value is set to the value obtained by using "Standard Particles 10.0 μm" (manufactured by Beckman Coulter Inc.). The threshold and the noise level are automatically set by pressing the "Threshold/Measure Noise Level" button. In addition, the current is set to 1600 μA, the gain is set to 2, the electrolyte is set to ISOTON II, and "Flush Aperture Tube After Each Run" is checked.

In the "Convert Pulses to Size Settings" window of the dedicated software, the bin spacing is set to log diameter, the number of size bins is set to 256 size bins, and the particle diameter range is set to from 2 μm to 60 μm.

A specific measurement method is as follows.

(1) About 200 ml of the aqueous electrolyte solution is loaded in a 250 ml round-bottom glass beaker dedicated for Multisizer 3, the beaker is set in a sample stand, and the content of the beaker is stirred by a stirrer rod at 24 rotations/sec. in a counterclockwise direction. Then, dirt and air bubbles in the aperture tube are removed by the "Flush Aperture Tube" function of the dedicated software.

(2) About 30 ml of the electrolyte solution is loaded in a 100 ml flat-bottom glass beaker. About 0.3 ml of a diluted liquid obtained by diluting "Contaminon N" (trade name; an aqueous 10% by mass solution of a neutral detergent for washing a precision measuring instrument, including a non-ionic surfactant, an anionic surfactant and an organic builder and having a pH of 7, produced by Wako Pure Chemical Industries, Ltd.) as a dispersant with ion-exchange water by a factor of about 3 in terms of mass is added thereto.

(3) An ultrasonic disperser "Ultrasonic Dispersion System Tetora 150" (trade name; manufactured by Nikkaki Bios, Co. Ltd.) in which two oscillators having an oscillating frequency of 50 kHz are installed so as to be out of phase by 180° and which has an electrical output of 120 W is prepared. About 3.3 l of ion-exchange water is loaded into a water tank of the ultrasonic disperser, and about 2 ml of Contaminon N is added into the water tank.

(4) The beaker in (2) above is set in the beaker fixing hole of the ultrasonic disperser, and the ultrasonic disperser is operated. Then, the height position of the beaker is adjusted so that the liquid level of the electrolyte solution in the beaker resonates to the maximum.

(5) About 10 mg of the toner is added in small portions to and dispersed in the aqueous electrolyte solution in the beaker in (4) above in the state where the aqueous electrolyte solution is irradiated with an ultrasonic wave. Then, the ultrasonic dispersion treatment is continued for an additional 60 seconds. In the ultrasonic dispersion, the water temperature in the water tank is appropriately adjusted so as to be in the range from 10° C. or higher and 40° C. or lower.

(6) The aqueous electrolyte solution in (5) above, in which the toner is dispersed, is dropped using a pipette in the round-bottom beaker in (1) above set in the sample stand, and the measurement concentration is adjusted to about 5%. Then, measurement is performed until the number of particles subjected to the measurement reaches 50000.

(7) The measurement data is analyzed by the dedicated software attached to the apparatus, and the weight average particle diameter (D4) is calculated. Herein, the "average size" on the "analysis/volume statistical values (arithmetic average)" window in setting of the dedicated software to graph/% by volume corresponds to the weight average particle diameter (D4).

EXAMPLES

Hereinafter, the present invention is described with reference to Examples and Comparative Examples in more detail, but the present invention is not limited thereto at all. Herein, the term "part(s)" in Examples and Comparative Examples all means "part(s) by mass" unless otherwise noted.

<Polyester Resin>

| | |
|---|---|
| Bisphenol A propylene oxide 2 mol adduct | 400 parts by mass |
| Bisphenol A propylene oxide 3 mol adduct | 280 parts by mass |
| Terephthalic acid | 120 parts by mass |
| Isophthalic acid | 120 parts by mass |

The above polyester monomers and 2 g of tetrabutyl titanate as a condensation catalyst were loaded, and reacted at 220° C. under a nitrogen stream while water generated was distilled off. Next, the resultant was cooled to 180° C., and 250 parts by mass of trimellitic anhydride was added thereto for reaction. After completion of the reaction, the resultant was taken out from a container, and cooled and pulverized to provide a polyester resin. The softening point Tm and the glass transition temperature Tg of the polyester resin were 118° C. and 60° C., respectively.

<Magnetic Members 1 and 2>

Magnetic member 1 and magnetic member 2 shown in Table 1 below were prepared for the magnetic member for use in production of the magnetic toner particle.

TABLE 1

| | Number average primary particle diameter D1 (nm) | Shape | Saturation magnetization at 796 kA/m ($Am^2/kg$) |
|---|---|---|---|
| Magnetic member 1 | 120 | Octahedron | 88 |
| Magnetic member 2 | 120 | Octahedron | 84 |

<Organic-Inorganic Composite Fine Particles 1 to 7>

Organic-inorganic composite fine particles 1 to 7 produced using the inorganic fine particle "b" shown in Table 2 according to Example 1 in International Publication No. WO2013/063291 were prepared for the organic-inorganic composite fine particle for use in production of the magnetic toner. Physical properties of organic-inorganic composite fine particles 1 to 7 are shown in Table 2.

<Organic-Inorganic Composite Fine Particle 8>

Thirty parts by mass of colloidal silica having a number average primary particle diameter (D1) of 15 nm was mixed with 100 parts by mass of resin fine particle 1 shown in Table 3 by a Henschel mixer to provide organic-inorganic composite fine particle 8. Physical properties of organic-inorganic composite fine particle 8 are shown in Table 2. Organic-inorganic composite fine particle 8 was magnified and observed by a scanning electron microscope "S-4800" (trade name; manufactured by Hitachi Ltd.), and it was found that colloidal silica adhered to the surface of resin fine particle 1, but was not embedded in the surface.

TABLE 3

| | Number average primary particle diameter D1 (nm) | True specific gravity ($g/cm^3$) | Shape factor SF2 |
|---|---|---|---|
| Resin fine particle 1 | 150 | 1.56 | 100 |
| Inorganic fine particle 1 | 200 | 2.21 | 100 |

<Inorganic Fine Particles a1 to a4>

Inorganic fine particles a1 to a4 shown in Table 4 below were prepared for the inorganic fine particle "a" for use in production of the magnetic toner.

TABLE 4

| | Type | Number average primary particle diameter D1 (nm) | Volume resistivity ($\Omega \cdot cm$) |
|---|---|---|---|
| Inorganic fine particle a1 | Iron oxide | 180 | $2 \times 10^4$ |
| Inorganic fine particle a2 | Sn—Zn composite oxide | 270 | $3 \times 10^5$ |
| Inorganic fine particle a3 | Titanium oxide | 230 | $6 \times 10^7$ |
| Inorganic fine particle a4 | Aluminum oxide | 200 | $1 \times 10^{15}$ |

Production Example 1 of Magnetic Toner Particle

Polyester resin: 100 parts

Magnetic member 1: 60 parts

Fischer-Tropsch wax (produced by Sasol Wax GmbH, C105, melting point: 105° C.): 1 part Charge controlling agent (produced by Hodogaya Chemical Co., Ltd., T-77): 2 parts After the above materials were pre-mixed by a Henschel mixer, the temperature was set and the materials were molten and kneaded using PCM-30 (manufactured by Ikegai) so that the temperature of a molten product at a discharge port was 150° C. The resulting kneaded product was cooled and roughly pulverized by a hammer mill, and thereafter finely pulverized using Turbo Mill T250 (manufactured by Freund-Turbo Corporation) as a pulverizer. The resulting finely pulverized powder was classified using a multi-division classifier utilizing the Coanda effect, to pro-

TABLE 2

| | Inorganic fine particle "b" | | Organic-inorganic composite fine particle | | |
|---|---|---|---|---|---|
| | Type | Number average primary particle diameter D1 (nm) | Number average primary particle diameter D1 (nm) | True specific gravity ($g/cm^3$) | Shape factor SF2 |
| Organic-inorganic composite fine particle 1 | Colloidal silica | 25 | 113 | 1.62 | 112 |
| Organic-inorganic composite fine particle 2 | Colloidal silica | 25 | 143 | 1.52 | 110 |
| Organic-inorganic composite fine particle 3 | Colloidal silica | 25 | 106 | 1.72 | 116 |
| Organic-inorganic composite fine particle 4 | Colloidal silica | 15 | 62 | 1.67 | 104 |
| Organic-inorganic composite fine particle 5 | Colloidal silica | 50 | 185 | 1.53 | 112 |
| Organic-inorganic composite fine particle 6 | Colloidal silica | 50 | 210 | 1.50 | 110 |
| Organic-inorganic composite fine particle 7 | Colloidal silica | 15 | 99 | 1.46 | 104 |
| Organic-inorganic composite fine particle 8 | Colloidal silica | 15 | 150 | 1.70 | 108 |

<Other Additives>

Physical properties of additives other than the organic-inorganic composite fine particle are shown in Table 3. A styrene-2-ethylhexyl acrylate-methyl methacrylate-methacrylic acid copolymer was used for resin fine particle 1, and colloidal silica was used for inorganic fine particle 1.

vide magnetic toner particle 1 having a weight average particle diameter (D4) of 6.7 μm.

Production Example 1 of Magnetic Toner

Magnetic toner particle 1 obtained in Production Example 1 of a magnetic toner particle was subjected to an external addition and mixing treatment using an apparatus illustrated in FIG. 1.

Figure 2:
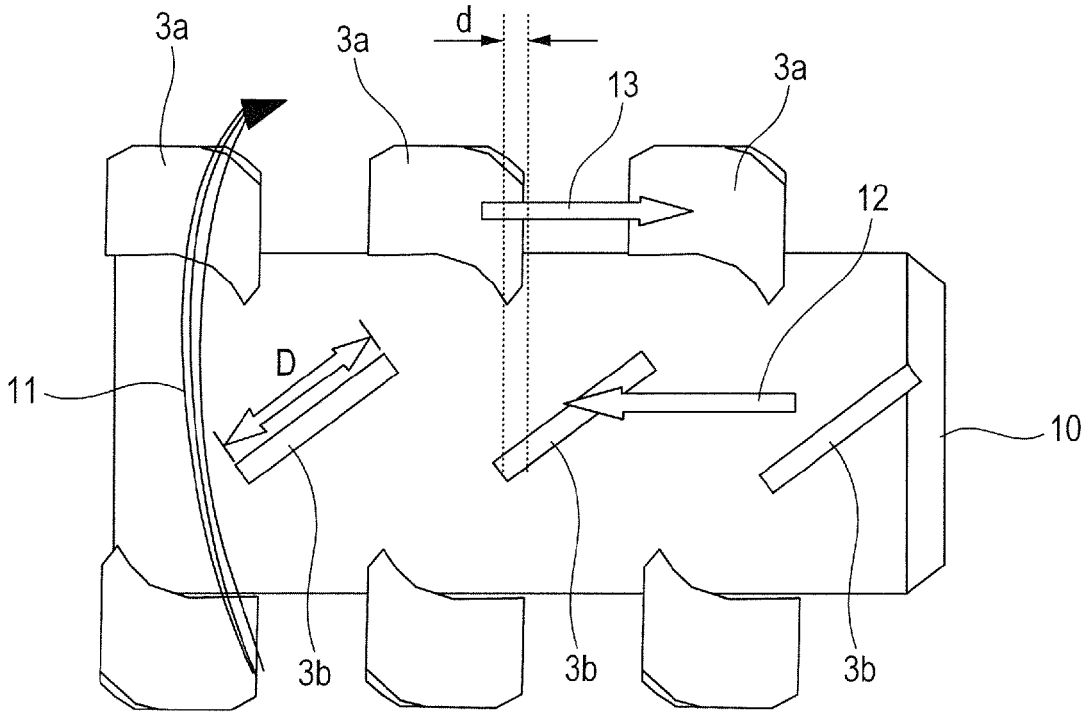
FIG. 2 is an illustration view of a stirring member of the apparatus in FIG. 1.

In the present Example, the apparatus illustrated in FIG. 1, including a main-body casing 1 having an inner periphery diameter of 130 mm and a treatment space 9 having a volume of $2.0\times10^{-3}$ $m^3$, was used, and the rated power of a driving portion 8 was set to 5.5 kW and the shape of a stirring member 3 was as illustrated in FIG. 2. Then, the overlapping width d of a stirring member 3*a* and a stirring member 3*b* in FIG. 2 was set to 0.25 D relative to the maximum width D of the stirring member 3, and the clearance between the stirring member 3 and the inner circumference of the main-body casing 1 was set to 3.0 mm. In FIG. 1 and FIG. 2, reference numeral 2 represents a rotating member, reference numeral 4 represents a jacket, reference numeral 5 represents a raw material loading port, reference numeral 6 represents a product discharge port, reference numeral 7 represents a central shaft, reference numeral 10 represents a side surface at the end of the rotating member, reference numeral 11 represents a rotation direction, reference numeral 12 represents a backward direction, reference numeral 13 represents a feeding direction, reference numeral 16 represents an inner piece for the raw material loading port, and reference numeral 17 represents an inner piece for the product discharge port.

The configuration of the apparatus described above was adopted, and 100 parts magnetic toner particle 1 and additives shown in Table 5 were loaded to the apparatus illustrated in FIG. 1.

The flow improver was used which was obtained by treating 100 parts of fumed silica (BET specific surface area: 130 $m^2$/g, number average primary particle diameter (D1): 16 nm) with 10 parts of hexamethyldisilazane and thereafter 10 parts of a dimethylsilicone oil.

After magnetic toner particle 1 and fumed silica were loaded, pre-mixing was performed in order to uniformly mix the magnetic toner particle with fumed silica. Pre-mixing conditions were as follows: the power of the driving portion 8 was 0.1 W/g (the number of rotations of the driving portion 8: 150 rpm) and the treatment time was 1 minute.

After completion of the pre-mixing, an external addition and mixing treatment was performed. The external addition and mixing treatment conditions were as follows: the periphery speed of the outermost end of the stirring member 3 was adjusted so that the power of the driving portion 8 was constantly 1.0 W/g (the number of rotations of the driving portion 8: 1800 rpm), and the treatment time was 5 minutes. The external addition and mixing treatment conditions are shown in Table 5.

After the external addition and mixing treatment, a rough particle and the like were removed by a circular vibration sieve provided with a screen having a diameter of 500 mm and an aperture of 75 μm, to provide magnetic toner 1. Physical properties of magnetic toner 1 are shown in Table 6.

The volume resistivity and the number average primary particle diameter (D1) of inorganic fine particle a1 analyzed from magnetic toner 1 were the same as the values shown in Table 4. In addition, the number average primary particle diameter (D1), the true specific gravity and the shape factor SF-2 of organic-inorganic composite fine particle 1 were the same as the values shown in Table 2.

Production Examples 2 to 6 of Magnetic Toner Particle

Each of magnetic toner particles 2 to 6 was obtained in the same manner as in Production Example 1 of a magnetic toner particle except that the type of the magnetic member and the number of parts thereof to be added were changed as shown in Table 5 in Production Example 1 of a magnetic toner particle.

TABLE 5

| | Binder resin | Magnetic member | Number of parts of magnetic member | Weight average particle diameter D4 (μm) |
|---|---|---|---|---|
| Toner particle 1 | Polyester resin | Magnetic member 1 | 60 | 6.7 |
| Toner particle 2 | Polyester resin | Magnetic member 1 | 30 | 6.7 |
| Toner particle 3 | Polyester resin | Magnetic member 1 | 70 | 6.8 |
| Toner particle 4 | Polyester resin | Magnetic member 2 | 30 | 6.7 |
| Toner particle 5 | Polyester resin | Magnetic member 2 | 15 | 6.8 |
| Toner particle 6 | Polyester resin | Magnetic member 1 | 80 | 6.7 |

Production Examples 2 to 17 of Magnetic Toner and Production Examples 1 to 7 of Comparative Magnetic Toner Each of magnetic toners 2 to 17 and comparative magnetic toners 1 to 7 was obtained in the same manner as in Production Example 1 of a magnetic toner particle except that the type of the inorganic fine particle "a" and the amount thereof to be added, and the type of the organic-inorganic composite fine particle and the amount thereof to be added were changed as shown in Table 6 in Production Example 1 of a magnetic toner particle.

Physical properties of magnetic toners 2 to 17 and comparative magnetic toners 1 to 7 are shown in Table 6.

The volume resistivity and the number average primary particle diameter (D1) of the inorganic fine particle "a" analyzed from each of magnetic toners 2 to 17 and comparative magnetic toners 1 to 7 were the same as the values shown in Table 4. In addition, the number average primary particle diameter (D1), the true specific gravity and the shape factor SF-2 of each of the organic-inorganic composite fine particle and inorganic fine particle 1 were the same as the values shown in Table 2.

TABLE 6

| | | Inorganic fine particle "a" | | | Organic-inorganic composite fine particle | | | Flow improver (fumed silica) | Physical properties of toner | | |
|---|---|---|---|---|---|---|---|---|---|---|---|
| | Toner particle Type | Type | Amount to be added (% by mass) | Content (% by mass) | Type | Amount to be added (% by mass) | Content (% by mass) | Amount to be added (% by mass) | True specific gravity of toner ($g/cm^3$) | Saturation magnetization of toner ($Am^2/kg$) | Amount of toner to be charged (mC/kg) |
| Magnetic toner 1 | 1 | a1 | 0.50 | 0.49 | 1 | 1.00 | 0.99 | 1.3 | 1.63 | 18.8 | −54 |
| Magnetic toner 2 | 1 | a1 | 0.50 | 0.49 | 2 | 1.00 | 0.98 | 1.3 | 1.63 | 18.8 | −52 |
| Magnetic toner 3 | 1 | a1 | 0.50 | 0.49 | 3 | 1.00 | 0.99 | 1.3 | 1.63 | 18.8 | −56 |
| Magnetic toner 4 | 2 | a1 | 0.50 | 0.49 | 1 | 1.00 | 0.98 | 1.3 | 1.45 | 14.1 | −58 |
| Magnetic toner 5 | 3 | a1 | 0.50 | 0.48 | 1 | 1.00 | 0.98 | 1.3 | 1.68 | 19.8 | −49 |
| Magnetic toner 6 | 4 | a1 | 0.50 | 0.49 | 1 | 1.00 | 0.99 | 1.3 | 1.45 | 13.5 | −59 |
| Magnetic toner 7 | 1 | a1 | 0.50 | 0.48 | 4 | 1.00 | 0.98 | 1.3 | 1.63 | 18.8 | −58 |
| Magnetic toner 8 | 1 | a1 | 0.50 | 0.48 | 5 | 1.00 | 0.98 | 1.3 | 1.63 | 18.8 | −50 |
| Magnetic toner 9 | 1 | a1 | 0.50 | 0.49 | 6 | 1.00 | 0.98 | 1.3 | 1.63 | 18.8 | −48 |
| Magnetic toner 10 | 1 | a1 | 0.50 | 0.49 | 6 | 0.60 | 0.59 | 1.3 | 1.63 | 18.8 | −46 |
| Magnetic toner 11 | 1 | a1 | 0.50 | 0.48 | 6 | 2.60 | 2.58 | 1.3 | 1.62 | 18.7 | −50 |
| Magnetic toner 12 | 1 | a1 | 0.50 | 0.48 | 6 | 0.40 | 0.39 | 1.3 | 1.63 | 18.8 | −45 |
| Magnetic toner 13 | 1 | a1 | 0.50 | 0.48 | 6 | 3.20 | 3.18 | 1.3 | 1.62 | 18.6 | −54 |
| Magnetic toner 14 | 1 | a2 | 0.40 | 0.39 | 6 | 0.40 | 0.39 | 1.3 | 1.63 | 18.8 | −46 |
| Magnetic toner 15 | 1 | a3 | 0.20 | 0.19 | 6 | 0.40 | 0.38 | 1.3 | 1.63 | 18.8 | −47 |
| Magnetic toner 16 | 1 | a1 | 4.00 | 3.98 | 6 | 0.40 | 0.38 | 1.3 | 1.65 | 18.6 | −36 |
| Magnetic toner 17 | 1 | a3 | 0.06 | 0.05 | 6 | 0.40 | 0.39 | 1.3 | 1.63 | 18.8 | −67 |
| Comparative magnetic toner 1 | 1 | a1 | 0.50 | 0.49 | — | — | — | 1.3 | 1.63 | 18.8 | −52 |
| Comparative magnetic toner 2 | 5 | a1 | 0.50 | 0.49 | 6 | 0.40 | 0.39 | 1.3 | 1.29 | 8.5 | −60 |
| Comparative magnetic toner 3 | 6 | a1 | 0.50 | 0.48 | 6 | 0.40 | 0.39 | 1.3 | 1.74 | 20.5 | −40 |
| Comparative magnetic toner 4 | 1 | a4 | 0.50 | 0.48 | 6 | 0.40 | 0.38 | 1.3 | 1.63 | 18.8 | −70 |
| Comparative magnetic toner 5 | 1 | a1 | 0.50 | 0.49 | 7 | 0.40 | 0.38 | 1.3 | 1.63 | 18.8 | −49 |
| Comparative magnetic toner 6 | 1 | a1 | 0.50 | 0.48 | 8 | 0.40 | 0.39 | 1.3 | 1.63 | 18.8 | −43 |
| Comparative magnetic toner 7 | 1 | a1 | 0.50 | 0.49 | — | — | — | 1.3 | 1.63 | 18.8 | −45 |

In Comparative magnetic toner 7, inorganic fine particle 1 was added in an amount of 0.40% by mass, and the content thereof was 0.39% by mass.

Example 1

For the machine for use in evaluation in the present Example, a commercial available magnetic one-component system printer HP LaserJet Enterprise 600 M603dn (manufactured by Hewlett-Packard Development Company, L.P.: process speed: 350 mm/s) was used. In the evaluation machine, magnetic toner 1 was used to perform the following evaluations. The evaluation results are shown in Table 7.

<Evaluation of Developability, Fogging and Transfer Efficiency>

In evaluation of the magnetic toner of the present invention, first, printing was performed under high-temperature and high-humidity (temperature: 32.5° C., relative humidity: 85%) in order that performances of the magnetic toner degraded in a long period of use were more easily determined. Subsequently, printing was performed under low-temperature and low-humidity (temperature: 10° C., relative humidity: 30%) where how charging performances of the magnetic toner were affected was easily evaluated.

Specifically, a predetermined process cartridge was filled with 1000 g of the magnetic toner. The printing test was performed for 40000 sheets in total under high-temperature and high-humidity in a mode set so that the lateral line pattern having a printing rate of 2% was output at 2 sheets/1 job and the next job was started once after the machine was stopped between jobs. The image density was measured at the $10^{th}$ sheet and the $40000^{th}$ sheet. Thereafter, the process cartridge was moved so as to be under low-temperature and low-humidity, and the printing test was performed for 3000 sheets in total in a mode set so that the lateral line pattern having a printing rate of 2% was output at 2 sheets/1 job and the next job was started once after the machine was stopped between jobs. The image density, the fogging and the transfer efficiency were measured at the $3000^{th}$ sheet.

The image density was measured by determining the reflection density of a 5-mm circular solid image by a reflection densitometer, namely, Macbeth densitometer (manufactured by Macbeth) using an SPI filter. It is indicated that the larger numerical value is better.

With respect to the fogging, after the printing test was performed for 3000 sheets under low-temperature and low-humidity, a solid white image was formed on paper, and the worst reflection density value in the white region was defined as Ds, the average reflection density of a transfer material before image formation was defined as Dr and the fogging value was defined as Dr−Ds. The reflection density in the white region was measured using a reflection densitometer (Reflect Meter Model TC-6DS manufactured by Tokyo Denshoku Co., Ltd.). It is indicated that the fogging is more suppressed as the numerical value is smaller.

With respect to the transfer efficiency, after the printing test was performed for 3000 sheets under low-temperature and low-humidity, a solid black image was continuously formed for five sheets, and such images were visually observed and evaluated.

A: No defect of transferred colorant was generated in all five sheets.

B: A slight defect of transferred colorant was observed in one sheet.

C: A slight defect of transferred colorant was observed in two to four sheets.

D: A slight defect of transferred colorant was observed in all five sheets.

E: A clear defect of transferred colorant was observed in one or more sheets.

<Evaluation of Low Temperature Fixability>

A fixing apparatus was altered so that the fixing temperature could be arbitrarily set.

The apparatus was used to regulate the temperature of a fixing unit in the range from 180° C. or higher and 220° C. or lower every 5° C., and a halftone image was output on bond paper (75 g/m$^2$) so that the image density was 0.60 to 0.65. The resulting image was subjected to sliding friction by lens-cleaning paper under a load of 4.9 kPa for five reciprocations, and the lowest temperature at which the rate of reduction in the image density before and after the sliding friction was 10% or less was determined and used for evaluation of the low temperature fixability. It is indicated that the low temperature fixability is better as the lowest temperature is lower. The low temperature fixability was evaluated under ordinary temperature and ordinary humidity (temperature: 25° C., relative humidity: 60%)

In Example 1, all the results obtained were good.

Examples 2 to 17 and Comparative Examples 1 to 7

The same evaluation as in Example 1 was performed using magnetic toners 2 to 17 and comparative magnetic toners 1 to 7. The evaluation results are shown in Table 7.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-161477, filed Aug. 7, 2014, which is hereby incorporated by reference herein in its entirety.

What is claimed is:

1. A magnetic toner comprising a magnetic toner particle containing a binder resin and a magnetic member, and an inorganic fine particle "a" and an organic-inorganic composite fine particle, wherein the magnetic toner has (i) a true specific gravity of 1.40 g/cm$^3$ or more and 1.70 g/cm$^3$ or less, and (ii) a saturation magnetization at a magnetic field of 796 kA/m of 10 Am$^2$/kg or more and 20 Am$^2$/kg or less, the inorganic fine particle "a" is a metal oxide having a volume resistivity of $1.0\times10^3$ Ω·cm or more and $1.0\times10^8$ Ω·cm or less, and the organic-inorganic composite fine particle comprises a resin particle, and an inorganic fine particle "b" embedded in the resin particle, and the organic-inorganic composite fine particle has a true specific gravity of 1.50 g/cm$^3$ or more and 1.75 g/cm$^3$ or less.

2. The magnetic toner according to claim 1, wherein a content of the organic-inorganic composite fine particle is

TABLE 7

| | | High-temperature and high-humidity environment (32.5° C., 85% RH) | | Low-temperature and low-humidity environment (10° C., 30% RH) | | | Low temperature |
|---|---|---|---|---|---|---|---|
| | | Image density at 10$^{th}$ sheet | Image density at 40000$^{th}$ sheet | Image density at 3000$^{th}$ sheet | Fogging at 3000$^{th}$ sheet | Transfer efficiency | fixability (° C.) |
| Example 1 | Magnetic toner 1 | 1.49 | 1.41 | 1.41 | 0.9 | A | 180 |
| Example 2 | Magnetic toner 2 | 1.48 | 1.40 | 1.40 | 0.9 | A | 180 |
| Example 3 | Magnetic toner 3 | 1.48 | 1.41 | 1.40 | 0.9 | A | 180 |
| Example 4 | Magnetic toner 4 | 1.47 | 1.40 | 1.39 | 1.3 | A | 170 |
| Example 5 | Magnetic toner 5 | 1.47 | 1.40 | 1.39 | 0.8 | A | 190 |
| Example 6 | Magnetic toner 6 | 1.47 | 1.39 | 1.35 | 1.4 | A | 170 |
| Example 7 | Magnetic toner 7 | 1.44 | 1.35 | 1.33 | 1.1 | A | 180 |
| Example 8 | Magnetic toner 8 | 1.42 | 1.33 | 1.31 | 1.7 | A | 180 |
| Example 9 | Magnetic toner 9 | 1.40 | 1.32 | 1.31 | 2.3 | B | 180 |
| Example 10 | Magnetic toner 10 | 1.40 | 1.32 | 1.30 | 2.5 | B | 175 |
| Example 11 | Magnetic toner 11 | 1.41 | 1.36 | 1.35 | 2.6 | A | 185 |
| Example 12 | Magnetic toner 12 | 1.40 | 1.31 | 1.30 | 2.9 | B | 175 |
| Example 13 | Magnetic toner 13 | 1.42 | 1.37 | 1.36 | 2.8 | A | 190 |
| Example 14 | Magnetic toner 14 | 1.40 | 1.30 | 1.29 | 2.9 | B | 175 |
| Example 15 | Magnetic toner 15 | 1.39 | 1.30 | 1.30 | 2.8 | B | 175 |
| Example 16 | Magnetic toner 16 | 1.35 | 1.28 | 1.27 | 2.8 | B | 175 |
| Example 17 | Magnetic toner 17 | 1.34 | 1.27 | 1.22 | 2.9 | B | 175 |
| Comparative Example 1 | Comparative magnetic toner 1 | 1.38 | 1.20 | 1.19 | 5.5 | E | 175 |
| Comparative Example 2 | Comparative magnetic toner 2 | 1.28 | 1.19 | 1.06 | 4.3 | D | 175 |
| Comparative Example 3 | Comparative magnetic toner 3 | 1.40 | 1.30 | 1.30 | 2.3 | B | 200 |
| Comparative Example 4 | Comparative magnetic toner 4 | 1.34 | 1.28 | 1.07 | 3.0 | E | 175 |
| Comparative Example 5 | Comparative magnetic toner 5 | 1.38 | 1.18 | 1.06 | 4.0 | D | 175 |
| Comparative Example 6 | Comparative magnetic toner 6 | 1.38 | 1.17 | 1.06 | 4.2 | D | 175 |
| Comparative Example 7 | Comparative magnetic toner 7 | 1.41 | 1.29 | 1.28 | 3.3 | C | 180 |

0.50% by mass or more and 3.00% by mass or less based on a mass of the magnetic toner.

3. The magnetic toner according to claim 1, wherein the organic-inorganic composite fine particle has (iii) a plurality of convex portions derived from the inorganic fine particle "b" on a surface, and (iv) a number average primary particle diameter (D1) of 50 nm or more and 200 nm or less.

4. The magnetic toner according to claim 1, wherein the organic-inorganic composite fine particle has a shape factor SF-2 of 103 or more and 120 or less.

5. The magnetic toner according to claim 1, wherein a content of the inorganic fine particle "a" is 0.05% by mass or more and 5.0% by mass or less based on a mass of the magnetic toner.

* * * * *